US006667752B2

(12) United States Patent
Wagner et al.

(10) Patent No.: US 6,667,752 B2
(45) Date of Patent: Dec. 23, 2003

(54) PRINTING MACHINE DISCHARGE DEVICE INCLUDING PLURALITIES OF EMITTERS FOR DIFFERENT DEGREES OF IMAGE RECEIVER CHARGE MANIPULATION

(75) Inventors: Moritz P. Wagner, Walworth, NY (US); Neville R. Phillips, Rochester, NY (US); Dennis A. Abramsohn, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/029,268

(22) Filed: Dec. 28, 2001

(65) Prior Publication Data

US 2003/0123901 A1 Jul. 3, 2003

(51) Int. Cl.[7] ..... G03G 15/04; G03G 21/06; G03G 21/08

(52) U.S. Cl. ..... 347/130; 399/128

(58) Field of Search ..... 399/127, 128, 399/220, 186, 187; 430/31; 347/123, 130, 238, 120

(56) References Cited

U.S. PATENT DOCUMENTS 4,538,900 A * 9/1985 Lutus et al. ..... 399/128
4,607,934 A * 8/1986 Kohyama et al. ..... 399/128
5,272,504 A * 12/1993 Omura et al. ..... 399/187
5,347,303 A 9/1994 Kovacs et al.
5,373,313 A 12/1994 Kovacs
5,444,463 A 8/1995 Kovacs et al.
5,807,652 A 9/1998 Kovacs
5,956,070 A 9/1999 Paoli et al.
6,133,933 A 10/2000 Paoli
6,208,819 B1 * 3/2001 Pai et al. ..... 399/128

FOREIGN PATENT DOCUMENTS

JP 10-97119 A * 4/1998

* cited by examiner

*Primary Examiner*—Joan Pendegrass
(74) *Attorney, Agent, or Firm*—David E. Henn

(57) ABSTRACT

A discharge device usable in an electrostatographic printing machine uses a plurality of emissions to discharge an image receiver, such as a photoreceptor, of the printing machine. The discharge device can be used as a charge erase device, a reconditioning device, an imaging device, or a combination of these. In embodiments, the different emissions come from different groups of emitters within the device, such as from rows of emitters or from groups interspersed within a single row. In other embodiments, at least some of the emitters are tunable and can emit more than one type of emissions. For example, tunable LEDs could be employed in the device.

22 Claims, 7 Drawing Sheets

PRINTING MACHINE DISCHARGE DEVICE INCLUDING PLURALITIES OF EMITTERS FOR DIFFERENT DEGREES OF IMAGE RECEIVER CHARGE MANIPULATION

CROSS-REFERENCE TO RELATED APPLICATION

This patent application is related to U.S. patent application No. 10/029,293 filed concurrently herewith (Attorney Docket No. D/A1134Q).

GENERAL FIELD OF ENDEAVOR

Embodiments of the subject invention relate to improved electrophotographic apparatus and method for controlling electrical memory effects in photoreceptors. More specifically, embodiments relate to apparatus and techniques for substantially reducing a form of electrical fatigue, occurring in such photoreceptors, that cause a "residual image" of a previous document in subsequent prints of a different document.

BACKGROUND AND SUMMARY

Electrophotographic marking is a well known and commonly used method of copying or printing documents. Electrophotographic marking is performed by exposing a light image representation of a desired document onto an image receiver, such as a substantially uniformly charged photoreceptor. In response to that image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration such that a desired composite color image results. That composite color image is then transferred and fused onto a substrate.

The REaD IOI process can be implemented using a number of different architectures. For example, in a single pass printer a composite final image is produced in one pass of the photoreceptor through the machine. A second architecture is a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

The single pass architecture is very fast, but expensive since four charging stations and four exposure stations are required. The four pass architecture is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

The residual image phenomenon is observed as a faint image of a previous document in initial copies of a new document after the previous document has been repeatedly imaged on the photoreceptor, i.e., after the photoreceptor has been cyclically charged overall and discharged, repeatedly in registry, by the light pattern from the previous document. This residual image effect is believed to be caused by the accumulation of charges trapped within the charge generating layer of the photoreceptor in an imagewise pattern corresponding to the previous document image. The speed (rate of discharge per unit exposure) of the photoreceptor is modified by this accumulation of trapped charges so that, upon exposure to a new document, the areas of the photoreceptor associated with the previous document pattern are discharged proportionally to their previous history and the new image is developed with toner simultaneously with a ghost of the previous image. It will be readily appreciated that such a ghost image is detractive from the esthetic viewpoint; however, the provision of previous document information in the subsequent document prints presents an even more serious problem when proprietary information is embodied in the previous document.

It is well known that fatigue of the type causing the residual image effect in photoconductive insulator members can be relieved to some extent by application of infrared radiation to, or otherwise heating, such members or by an overall flooding of such members with light (see for example, U.S. Pat. No. 2,863,767). Also, it has been noted that some regeneration of such a fatigued member can be effected by application of an electrostatic charge, of polarity opposite that of the primary (sensitizing) charge, at some time after the development step and before any subsequent sensitizing step of a copy/print cycle (see for example, U.S. Pat. No. 2,741,959). However, in certain electrophotographic apparatus, e.g., one employing a REaD IOI process, in which a photoreceptor is rapidly exposed a large number of times to the same image, and in which the latent image is not completely erased between each subsequent exposure and development step, the residual image problem is more pronounced. Specifically, in the ReaD IOI process, the differential history of each portion of the image area, with parts being charged and recharged at each subsequent station without exposure while others are charged and exposed several times, causes a pronounced residual image problem. In this case, the above-noted prior art techniques have been found impractical and/or to inadequately eliminate residual image, at least in certain such members.

To erase residual electrostatic charge from the photoreceptor, conventional printing machines employ an erase source that either faces the image area on the front surface of the photoreceptor ("front erase") or faces and penetrates semi-transparent or translucent layers from the rear of the photoreceptor ("rear erase"). This conventional arrangement generally has been adequate for black and white reproductions and in color machines employing three or more pass architectures. Conventional erase arrangements may be inadequate in certain situations for high quality color reproductions and especially for printing machines employing a single pass image on image architecture (with no erase after every development station). Such conventional erase arrangements may create ghost images (i.e., residual image effect) and slight voltage non-uniformities that result in objectionable color shifts. Thus, there is a need, which the present invention addresses for new apparatus and new methods that can alleviate the above described residual image problem.

Electrostatic charge erase apparatus and methods, as well as other parts of printing machines, are disclosed in U.S. Pat. No. 4,035,750, issued to Staudenmayer et al.; U.S. Pat. No. 5,748,221, issued to Castelli et al.; U.S. Pat. No. 5,848,335, issued to Folkins et al.; U.S. Pat. No. 5,394,230, Kaukeinen et al.; and, U.S. Pat. No. 4,728,985, issued to Nakashima et al.; U.S. Pat. No. 5,778,288, issued to Tabb et al.; U.S. Pat. No. 5,079,121, issued to Facci et al.; and U.S. Pat. No. 5,933,177, issued to Pollutro et al. Reconditioning systems are also disclosed in U.S. Pat. No. 6,208,819, issued to Pai et al.; and U.S. Pat. No. 6,223,011, issued to Abramsohn et al.

To further reduce and/or substantially eliminate residual images, embodiments contemplate use of a multiple emission dischage device. Embodiments comprise a discharge device including a plurality of emitters distributed along the discharge device. A first quantity of the plurality of emitters emit first emissions that can change the charge state of an image receiver, such as the photoreceptor of an electrostatographic printing machine. At least one more quantity of the plurality of emitters emit at least one respective additional emission that can change the charge state of an image receiver. The emissions can be light, ions, or any other suitable type of emissions that can change the charge state of an image receiver.

In embodiments, the emitters are arranged along a single axis. The first quantity of emitters can be interspersed with the at least one additional quantity of emitters, as in an alternating relationship. Thus, the device can be a bar of LEDs arranged so that the first, third, fifth, etc., LEDs belong to the first quantity of emitters and emit a first frequency of light, and the second, fourth, sixth, etc., LEDs belong to a second quantity of emitters emit a second frequency of light. In embodiments employing three emissions, every third emitter can belong to the same group; where four emissions are used, every fourth emitter; where five are used, every fifth emitter; and so forth.

Alternate embodiments have the emitters arranged in rows with each quantity of emitters having its own row or rows. Thus, the device can, for example, take the form of a bar of LEDs arranged in rows along the bar so that the first quantity of emitters is one row of LEDs, a second quantity of emitters is a second row of LEDs, and so forth. Other embodiments could, of course, have the emitters arranged differently, depending on the particular emissions used and the particular environment in which the discharge device is employed.

As mentioned above, the emitters can be LEDs, and it should be apparent to those of skill in the art that any suitable emitter could be used. Examples of such emitters include, but are not limited to, LEDs, gas discharge lamps, excimer/gas discharge lasers, filament lamps, ion beam generators, and broadband emitters. In embodiments, some or all of the emitters can be tunable so that a single quantity of emitters can emit more than one type of emissions. For example, the device could include a bar of tunable LEDs that can selectively emit different wavelengths of light as conditions warrant.

Embodiments of the device can be used to discharge image receivers in various ways. For example, embodiments can be used to image, erase, and/or recondition photoreceptor belts and other image receivers, especially in electrostatographic printing devices, like laser printers and digital photocopiers. In particular, embodiments can be employed to discharge photoreceptors with a single layer responsive to the emissions, whereas prior art multiple wavelength devices encompasses only multiple layer photoreceptors. In such embodiments, the discharge device can be used by providing the device in an electrostatographic printing machine including a photoreceptor, selectively directing emissions from the first quantity of the plurality of emitters at the photoreceptor to induce a first level of discharge of the photoreceptor, and selectively directing emissions from the at least one more quantity of the plurality of emitters at the photoreceptor to induce at least one additional level of discharge of the photoreceptor.

The discharge device can, for example, be arranged as part of a reconditioning station, with the first quantity of emitters achieving a first degree of photoreceptor reconditioning, and second and subsequent quantities of emitters achieving additional degrees of reconditioning. Similarly, the device can be arranged as part of an erase station, with the first quantity of emitters achieving a first degree of photoreceptor erasure, and second and subsequent quantities of emitters achieving additional degrees of erasure. Additionally, the device can be arranged as part of an imaging station, with the first quantity of emitters achieving a first degree of photoreceptor imaging, and second and subsequent quantities of emitters achieving additional degrees of imaging. Further, the device can be configured to achieve more than one of these functions. For example, the device can be arranged as part of an erase station, with the first quantity of emitters achieving a first degree of photoreceptor erasure, and second and subsequent quantities of emitters achieving degrees of reconditioning and/or erasure. The combinations could even include a single station that can image, erase, and recondition.

Embodiments can be deployed, for example, in one or more of an imaging, erase, and reconditioning stations in an electrostatographic printing machine, such as a machine comprising:

(a) a photoreceptor having an image area;

(b) at least one charging apparatus and at least one imaging apparatus that create a plurality of complementary electrostatic latent images on the image area to correspond to an image wherein the creation of the plurality of the complementary electrostatic latent images involves a substantially uniform charging and an imagewise discharge of the image area for each of the complementary electrostatic latent images and results in a variation in the quantity of trapped charges among different portions of the image area, thereby leading to differential residual voltage among the different portions of the image area;

(c) a plurality of complementary electrostatic latent image developing apparatus;

(d) a charge erase device that directs charge dissipation emissions at the photoreceptor to reduce the quantity of the surface charges; and (e) a reconditioning light source that directs light at the photoreceptor to reduce the variation in the quantity of the trapped charges among the different portions of the image area, thereby creating a more uniform residual voltage among the different portions of the image area.

The at least one charging apparatus refers to for example devices 22 and 36*a–c*.

The at least one imaging apparatus refers to for example devices 24 and 38*a–c*.

The plurality of complementary electrostatic latent image developing apparatus refers to for example development stations C, D, E, and F.

In embodiments, the inventive printing machine further includes a residual developer cleaning device that removes residual developer particles from the photoreceptor, wherein the charge erase device directs the charge dissipation emissions at the photoreceptor subsequent to the removal of the residual developer particles by the residual developer cleaning device.

A residual developer cleaning device that removes residual developer particles from the photoreceptor, wherein the reconditioning light source directs light at the photoreceptor subsequent to the removal of the residual developer particles by the residual developer cleaning device can also be used.

BRIEF DESCRIPTION OF THE DRAWINGS

Other aspects of the present invention will become apparent as the following description proceeds and upon reference to the Figures.

Unless otherwise noted, the same reference numeral in different Figures refers to the same or similar feature.

DETAILED DESCRIPTION

Figure 1:
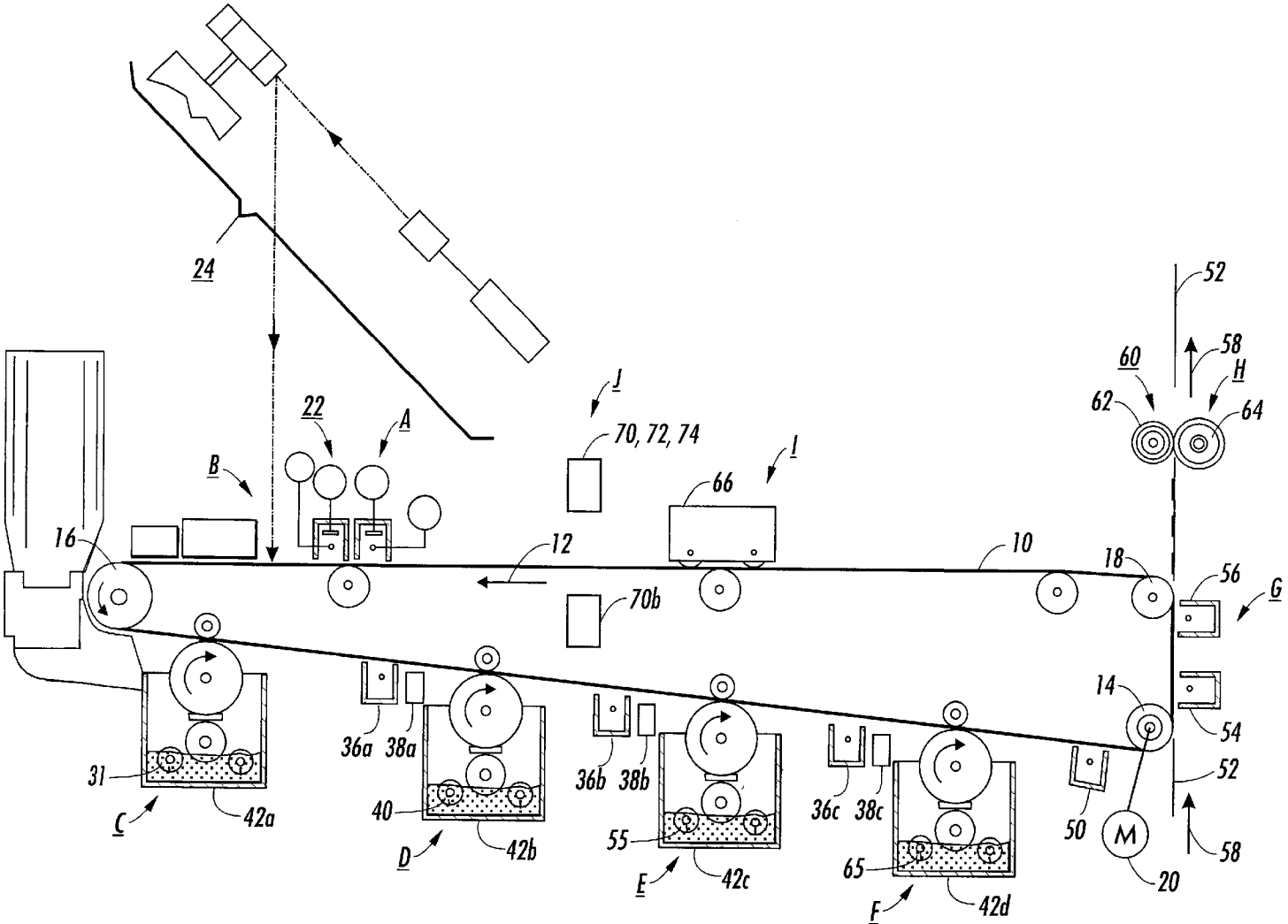
FIG. 1 is a schematic diagram of a four color printing machine using at least one discharge device according to embodiments of the present invention in a dual-erase/recondition station.
Figure 2:
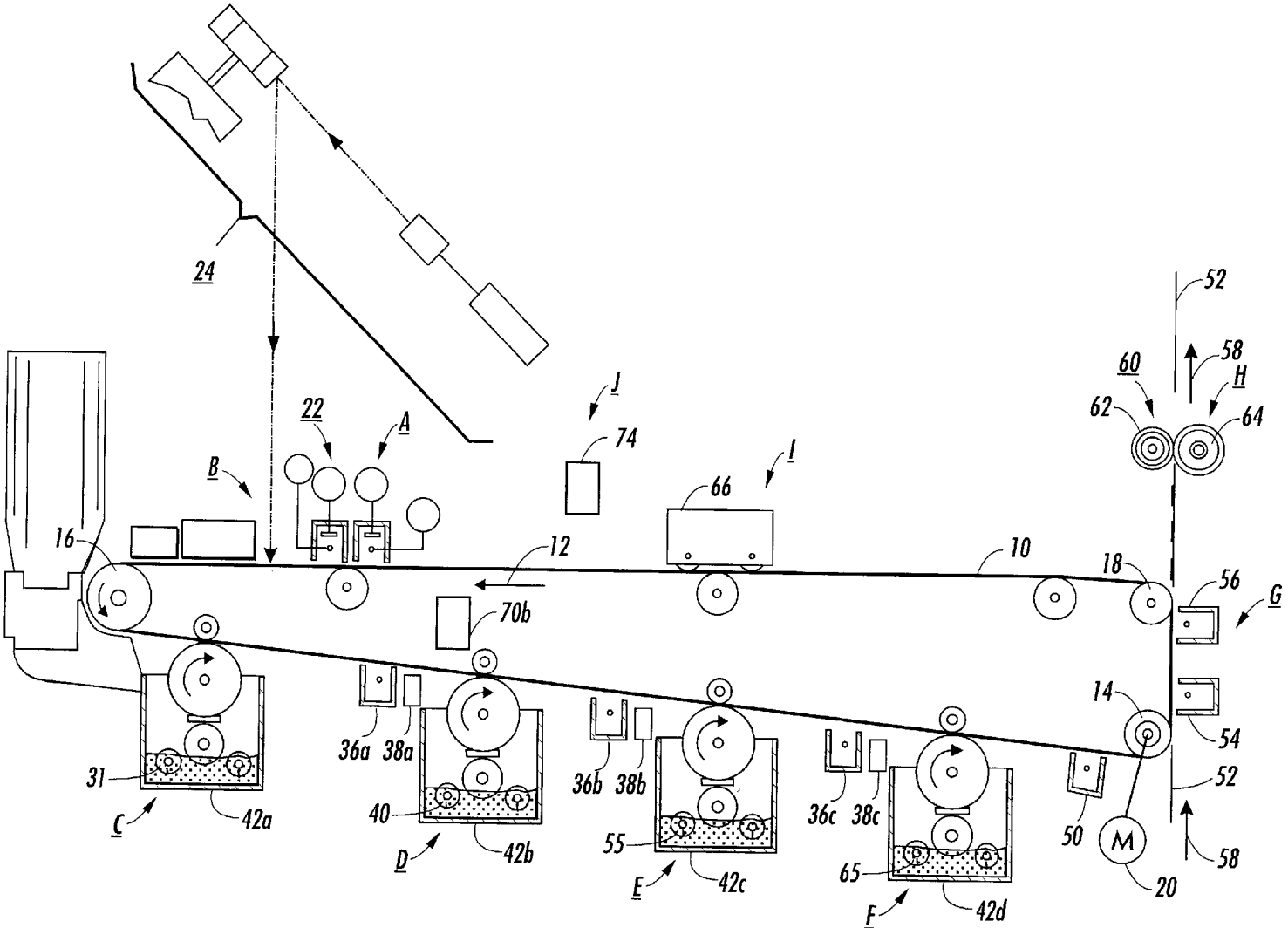
FIG. 2 is a schematic diagram of a four color image printing machine using at least one discharge device according to embodiments of the present invention in a dual-erase station.
Figure 3:
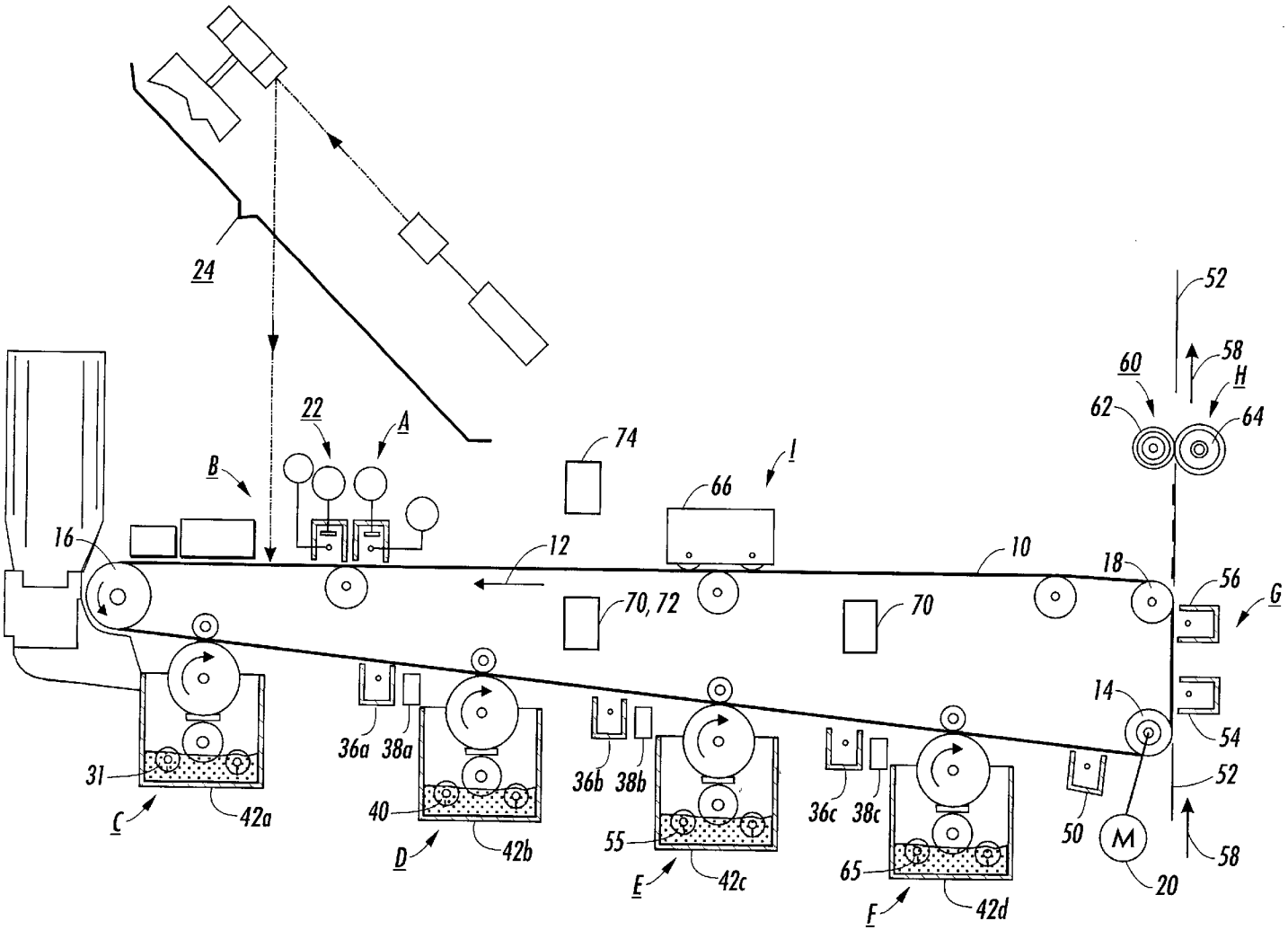
FIG. 3 is a schematic diagram of a four color image printing machine using at least one discharge device according to embodiments of the present invention in a dual-erase station.

The phrase "complementary electrostatic latent images" refers to a plurality of latent images that when placed in registry form a composite latent image corresponding to a single image. Each of the complementary electrostatic latent images is developed with developer particles of a different color.

Embodiments comprise a discharge device including a plurality of emitters distributed along the discharge device. A first quantity of the plurality of emitters emit first emissions that can change the charge state of an image receiver, such as the photoreceptor of an electrostatographic printing machine. At least one more quantity of the plurality of emitters emit at least one respective additional emission that can change the charge state of an image receiver. The emissions can be light, ions, or any other suitable type of emissions that can change the charge state of an image receiver.

In embodiments, the emitters are arranged along a single axis. The first quantity of emitters can be interspersed with the at least one additional quantity of emitters, as in an alternating relationship. Thus, the device can be a bar of LEDs arranged so that the first, third, fifth, etc., LEDs belong to the first quantity of emitters and emit a first frequency of light, and the second, fourth, sixth, etc., LEDs belong to a second quantity of emitters emit a second frequency of light. In embodiments employing three emissions, every third emitter can belong to the same group; where four emissions are used, every fourth emitter; where five are used, every fifth emitter; and so forth.

Alternate embodiments have the emitters arranged in rows with each quantity of emitters having its own row or rows. Thus, the device can, for example, take the form of a bar of LEDs arranged in rows along the bar so that the first quantity of emitters is one row of LEDs, a second quantity of emitters is a second row of LEDs, and so forth. Other embodiments could, of course, have the emitters arranged differently, depending on the particular emissions used and the particular environment in which the discharge device is employed.

As mentioned above, the emitters can be LEDs, and it should be apparent to those of skill in the art that any suitable emitter could be used. Examples of such emitters include, but are not limited to, LEDs, gas discharge lamps, excimer/gas discharge lasers, filament lamps, ion beam generators, and broadband emitters. In embodiments, some or all of the emitters can be tunable so that a single quantity of emitters can emit more than one type of emissions. For example, the device could include a bar of tunable LEDs that can selectively emit different wavelengths of light as conditions warrant.

Embodiments of the device can be used to discharge image receivers in various ways. For example, embodiments can be used to image, erase, and/or recondition photoreceptor belts and other image receivers, especially in electrostatographic printing devices, like laser printers and digital photocopiers. In particular, embodiments can be employed to discharge photoreceptors with a single layer responsive to the emissions, whereas prior art multiple wavelength devices encompasses only multiple layer photoreceptors. In such embodiments, the discharge device can be used by providing the device in an electrostatographic printing machine including a photoreceptor, selectively directing emissions from the first quantity of the plurality of emitters at the photoreceptor to induce a first level of discharge of the photoreceptor, and selectively directing emissions from the at least one more quantity of the plurality of emitters at the photoreceptor to induce at least one additional level of discharge of the photoreceptor.

The discharge device can, for example, be arranged as part of a reconditioning station, with the first quantity of emitters achieving a first degree of photoreceptor reconditioning, and second and subsequent quantities of emitters achieving additional degrees of reconditioning. Similarly, the device can be arranged as part of an erase station, with the first quantity of emitters achieving a first degree of photoreceptor erasure, and second and subsequent quantities of emitters achieving additional degrees of erasure. Additionally, the device can be arranged as part of an imaging station, with the first quantity of emitters achieving a first degree of photoreceptor imaging, and second and subsequent quantities of emitters achieving additional degrees of imaging. Further, the device can be configured to achieve more than one of these functions. For example, the device can be arranged as part of an erase station, with the first quantity of emitters achieving a first degree of photoreceptor erasure, and second and subsequent quantities of emitters achieving degrees of reconditioning and/or erasure. The combinations could even include a single station that can image, erase, and recondition.

Turning now to FIG. 1, a printing machine in which embodiments of the present invention can be used includes an image receiver, such as a charge retentive surface in the form of an organic type photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

As the photoreceptor belt travels, each part of it passes through each of the process stations described herein. For convenience, a single section of the photoreceptor belt, referred to as the image area, is identified. The image area is that part of the photoreceptor belt which is to receive the toner layer or layers which, after being transferred and fused to a substrate, produce the final color image. While the photoreceptor belt may have numerous image areas, since each image area is processed in the same way, a description of the processing of one image area suffices to fully explain the operation of the printing machine.

The image area, processing stations, belt travel, and cycles define two relative directions, upstream and downstream. A given processing station is downstream of a second processing station if, in a given cycle, the image area passes the given processing station after it passes the second processing station. Conversely, a given processing station is upstream of a second processing station if, in a given cycle, the image area passes the given processing station before it passes the second processing station.

An image area of belt 10 passes through charging station A where a corona generating device, indicated generally by the reference numeral 22, charges the photoconductive surface of belt 10 to a relative high, substantially uniform, preferably negative potential.

Figure 4:
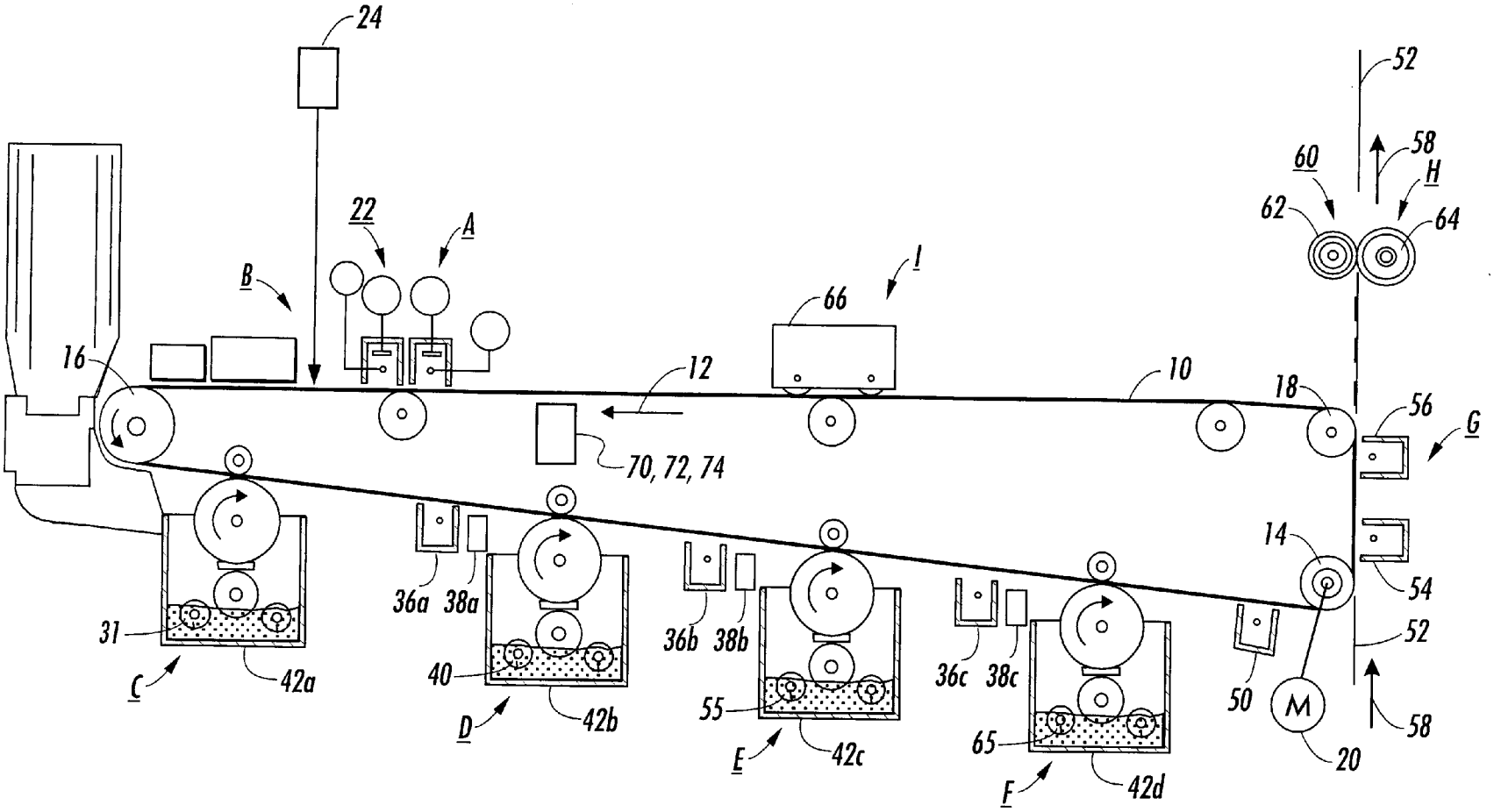
FIG. 4 is a schematic diagram of a four color image printing machine using at least one discharge device according to embodiments of the present invention in a dual-erase/recondition station and/or as an imager.
Figure 5:
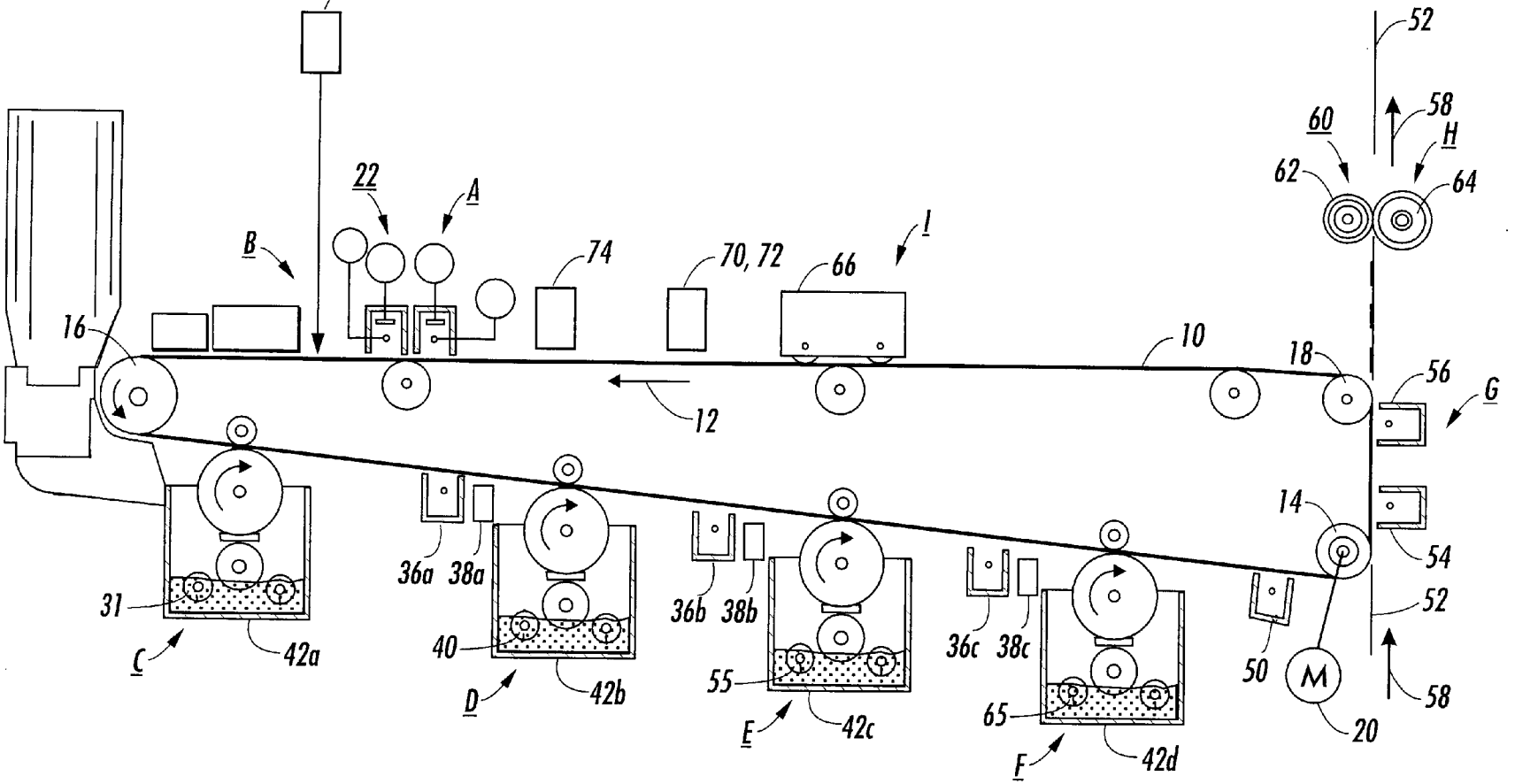
FIG. 5 is a schematic diagram of a four color image printing machine using at least one discharge device according to embodiments of the present invention in a dual-erase station and/or as an imager.
Figure 6:
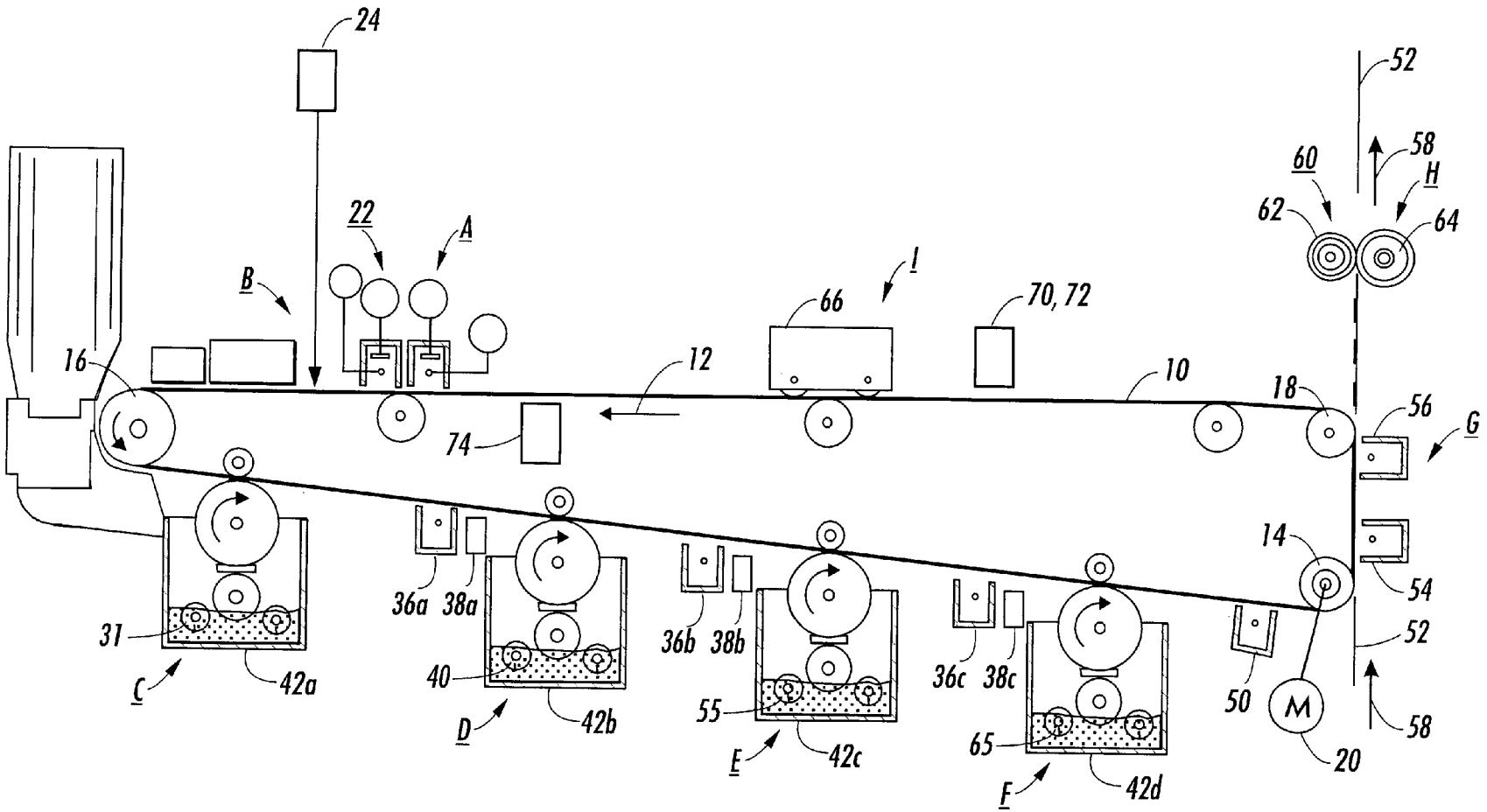
FIG. 6 is a schematic diagram of a four color image printing machine using at least one discharge device according to embodiments of the present invention in a dual-erase station and/or as an imager.

Next, the charged image area of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays, as seen particularly in FIGS. 4–6.

The photoreceptor, which is initially charged to a voltage Vo, undergoes dark decay to a level $V_{ddp}$ equal to about −500 volts. When exposed at the exposure station B with the maximum output level, it is discharged to $V_{background}$ equal to about −50 volts. Many levels of exposure between none and the maximum level can be used at station B to produce discharge levels at all voltages between $V_{ddp}$ and $V_{background}$ Thus after exposure, the photoreceptor contains a voltage profile of high to low voltages, the former corresponding to charged areas where one later wants untoned areas and the latter corresponding to discharged areas where one later develops maximum amounts of toner. Voltage levels in between develop proportionally lesser amounts of toner.

At a first development station C, containing a developer housing structure 42*a*, developer particles 31 including toner particles of a first color such as black are conveyed from the developer housing structure 42*a* to develop the electrostatic latent image. Appropriate developer biasing is accomplished via power supply (not shown).

A corona recharge device 36*a* having a high output current versus control surface voltage (I/V) characteristic slope is employed for raising the voltage level of both the toned and untoned areas on the photoreceptor to a substantially uniform level. The recharging device 36*a* serves to recharge the photoreceptor to a predetermined level.

A second exposure or imaging device 38*a* which may comprise a laser based input and/or output structure is utilized for selectively discharging the photoreceptor on toned areas and/or bare areas, pursuant to the image to be developed with the second color developer. At this point, the photoreceptor contains toned and untoned areas at relatively high voltage levels and toned and untoned areas at relatively low voltage, levels. These low voltage areas represent image areas which are developed using discharged area development (DAD). To this end, a negatively charged, developer material 40 comprising color toner is employed. The toner, which by way of example may be yellow, is contained in a developer housing structure 42*b* disposed at a second developer station D and is presented to the latent images on the photoreceptor by a magnetic brush developer roller. A power supply (not shown) serves to electrically bias the developer structure to a level effective to develop the DAD image areas with negatively charged yellow toner particles 40.

The above procedure is repeated to deposit developer particles of a third color. A corona recharge device 36*b* having a high output current versus control surface voltage (I/V) characteristic slope is employed for raising the voltage level of both the toned and untoned areas on the photoreceptor to a substantially uniform level. The recharging device 36*b* serves to recharge the photoreceptor to a predetermined level.

A third exposure or imaging device 38*b* which may comprise a laser based input and/or output structure is utilized for selectively discharging the photoreceptor on toned areas and/or bare areas, pursuant to the image to be developed with the third color developer. At this point, the photoreceptor contains toned and untoned areas at relatively high voltage levels and toned and untoned areas at relatively low voltage, levels. These low voltage areas represent image areas which are developed using discharged area development (DAD). To this end, a negatively charged, developer material 55 comprising color toner is employed. The toner, which by way of example may be magenta, is contained in a developer housing structure 42*c* disposed at a developer station E and is presented to the latent images on the photoreceptor by a magnetic brush developer roller. A power supply (not shown) serves to electrically bias the developer structure to a level effective to develop the DAD image areas with negatively charged magenta toner particles 55.

The above procedure is repeated to deposit developer particles of a fourth color. A corona recharge device 36*c* having a high output current versus control surface voltage (I/V) characteristic slope is employed for raising the voltage level of both the toned and untoned areas on the photoreceptor to a substantially uniform level. The recharging device 36*c* serves to recharge the photoreceptor to a predetermined level.

A fourth exposure or imaging device 38*c* which may comprise a laser based input and/or output structure is utilized for selectively discharging the photoreceptor on toned areas and/or bare areas, pursuant to the image to be developed with the fourth color developer. At this point, the photoreceptor contains toned and untoned areas at relatively high voltage levels and toned and untoned areas at relatively low voltage, levels. These low voltage areas represent image areas which are developed using discharged area development (DAD). To this end, a negatively charged, developer material 65 comprising color toner is employed. The toner, which by way of example may be magenta, is contained in a developer housing structure 42*d* disposed at a developer station F and is presented to the latent images on the photoreceptor by a magnetic brush developer roller. A power supply (not shown) serves to electrically bias the developer structure to a level effective to develop the DAD image areas with negatively charged magenta toner particles 65.

Thus, in the manner described herein a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images in direction 58 at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by both the image and the non-image areas on the photoconductive surface are removed therefrom. These particles are removed at cleaning station I using a cleaning brush structure contained in a housing 66.

In FIG. 1, a single erase station J includes discharge devices for erasing and reconditioning devices. For example, erase station J can include a first discharge device according to embodiments employed as a charge erase device 70 emitting emissions of one type to discharge/dissipate charge in the photoreceptor, as well as a second discharge device according to embodiments employed as a charge erase device 72 emitting emissions of a second type, different from or the same as the first emissions, for further erasure of the photoreceptor, and a third discharge device according to embodiments and employed as a reconditioning device 74 emitting third emissions of a third type, different from or the same as the other two, to which the photoreceptor responds. Of course, all three discharge device functions could be included in a single discharge device according to embodiments including three groups of emitters emitting the first, second, and third emissions respectively; in embodiments employing tunable emitters, one or more of the first, second, and third emissions could be emitted by a single group of emitters in the discharge device. By consolidating the erasure and reconditioning into a single station, one saves a significant amount of space within the printing machine.

Rather than consolidate erasure and reconditioning into a single station, one could still save space by instead employing a reconditioning station 74 downstream from the cleaning station I and an erase station J upstream or downstream from the cleaning station I. According to preferred embodiments, the erase station J applies at least two discharge emissions from either a single discharge device according to embodiments employed as a charge erase device and including a first group of emitters 70 emitting emissions of one type to discharge/dissipate charge in the photoreceptor, as well as a group of emitters 72 emitting emissions of a second type, different from or the same as the first emissions, for further erasure of the photoreceptor; or the two discharge can come from two discharge devices according to embodiments with a first discharge device 70 emitting first emissions and a second discharge device emitting second emissions, different from or the same as the first emissions, for further erasure of the photoreceptor.

When upstream from cleaning station I, erase station J directs charge dissipation emissions at the photoreceptor to reduce the quantity of the surface charges, facilitating the removal of residual toner particles by cleaning station I by eliminating a substantial portion of the electric field that still holds charged toner to the photoreceptor. In areas where there is still some charged toner in proximity to surface charges, the electric field needed to bring opposite sign charges from the charge generating layer to the surface charges may not be sufficient, and some surface charges may still remain. When downstream from cleaning station I, erase station J directs charge dissipation emissions at the photoreceptor to reduce the quantity of the surface charges. The use of a charge erase device after removal of most charged toner effectively erases almost all of the remaining surface charges.

In embodiments, exposure to the charge dissipation emissions discharge a substantial portion of the surface charges in the image area, preferably to a substantially uniform residual voltage of below about 25 volts and preferably below about 10 volts after exposure to both devices (70,72). The variation in the residual voltage is preferably less than about 10 volts peak to peak. Each image area on the photoreceptor undergoes exposure to both erase devices (70,72).

The discharging of the residual charges in the image area may occur at any suitable moment in the xerographic process. For instance, erase station J could be positioned inside or outside the belt 10 at any position downstream of developer station F provided that sufficient charge dissipation emissions can reach the charge generation layer of the belt, for instance light emissions from the front of the belt at a wavelength to which the photoreceptor is sensitive but to which the developed toner layers are essentially transparent or translucent.

In embodiments, the charge dissipation emissions are directed at the image area portion or from the corresponding region on the rear surface of the photoreceptor. This can be accomplished by positioning erase station J on one side or the other of the photoreceptor.

As mentioned above, the discharge devices (70,72) can be a light source (emitting same or different light wavelengths), a charge generating device (same or different kind of charge generating device), an ion beam generator, an electron gun, or another emitter suitable for discharging the photoreceptor, or a combination of these. Suitable light sources include for example incandescent lamps such as tungsten lamps and halogen lamps, fluorescent lamps, neon lamps, light emitting diodes, and electroluminescent strips. Charge erase devices (70,72) may be a broadband light source ranging for example from about 400 to about 800 nanometers but preferably in a range chosen to match the sensitivity of the charge generation layer of the photoreceptor or a narrow-band light source (including a single wavelength light source) ranging for example up to plus or minus about 10 nanometers around a peak wavelength chosen to generate charge in the charge generation layer of the photoreceptor. Using two erase sources of different wavelengths, different directions, and different energies can advantageously eliminate more of the unwanted residual charges, wherever their location, than using either erase source alone.

Where light is used by the discharge devices, the light exposure provided by each discharge device (70,72,74) for each image area ranges for example from about 10 to about 80 ergs/cm$^2$, preferably from about 20 to about 30 ergs/cm$^2$ at the charge generation layer of the photoreceptor. The light exposure provided by erase device 70 may be the same or different from that provided by the erase device 72.

Where discharge devices emit ions, suitable charge generating devices include corotrons, scorotrons, dicorotrons, and the like. In embodiments, a scorotron may be used such as a DC scorotron with a charge opposite that of the photoreceptor charge. A DC scorotron with a electrically grounded screen separated from the photoreceptor surface by 1 to 4 mm and preferably 1 to 2 mm will cause the entire photoreceptor surface potential to reach a uniform residual voltage of substantially zero volts.

Each discharge device can face either the front surface or the rear surface of the photoreceptor. FIGS. 1–6 depict discharge devices (70,72) as facing the rear surface of the photoreceptor. Where the discharge devices (70,72) emit ions, however, erase devices (70,72) preferably face the front surface of the photoreceptor.

Preferably downstream from cleaning station I, reconditioning discharge device 74 directs light at the photoreceptor to reduce the variation in the quantity of the trapped charges among the different portions of the image area, thereby creating a substantially more uniform residual voltage among the different portions of the image area. In embodiments, the reconditioning discharge device directs light at the photoreceptor only during a non-printing time. A non-printing time is defined as that time when the print engine is not actually performing electrostatographic cycles to produce prints. This can be when there are no jobs in the print queue, or during the time between print jobs when the print engine is idle, or during long printing jobs when the print job can be interrupted to allow light from the reconditioning light source to reduce variations in the residual potential. During the non-printing time, some components of the xerographic process, such as charging devices and exposure devices may be run concurrently to aid in the reconditioning of the photoreceptor. Since the reconditioning light source directs light preferably only during a non-printing time, it can be positioned at any suitable position during the xerographic printing process. The FIGS. depict reconditioning discharge device 74 as facing the front surface of the photoreceptor and positioned between charging station A and cleaning station I. Reconditioning discharge device 74 can also be placed at any location around the print cycle where the photoreceptor can maintain a negative charge state caused by one of the charging devices (downstream of 22, 36*a*, 36*b*, or 36*c*). In other embodiments, the reconditioning discharge device can face the rear surface of the photoreceptor. In addition, the reconditioning discharge device 74 and erase discharge devices (70,72) can all face the front surface of the photoreceptor; in other embodiments, the reconditioning discharge device 74 and erase discharge devices (70,72) can all face the rear surface of the photoreceptor.

The reconditioning discharge device discharges or eliminates trapped charges within the photoreceptor such as within the charge generating layer and at the interface between the charge generating layer and the charge transport layer. The reconditioning discharge device discharges the image area to a residual voltage of below about 5 volts, where the residual voltage is substantially uniform, preferably practically uniform, across the entire image area. However, the actual measure of reduction or elimination of these trapped charges is not seen as a significant residual voltage decrease, but the increased uniformity of the residual voltage across the entire image area results in the elimination of increased dark decay and of residual image creation in the subsequent images.

It is well known to those who practice the art of xerographic printing that trapped charges within the charge generating layer or at the interface between the charge generating layer and the charge transport layer are located close to the electrical ground plane and may maintain high electric fields which change the electrical properties of the photoreceptor locally but which are not strong contributors to residual potential levels. For example, the removal of a surface charge by a standard charge erasing device, when that surface charge is separated from the ground plane by a charge transport layer of a dielectric thickness (equal to physical thickness divided by dielectric constant) of 20 micrometers, changes the residual voltage by a factor of >20 times the amount of change in the residual voltage caused by the removal of the same amount of charge trapped in a charge generating layer with a dielectric constant of 2 located 2 micrometers away from the ground plane. Each image area on the photoreceptor undergoes exposure to the reconditioning light source. Surface charges are also partially or totally eliminated by exposure to the reconditioning light source.

Suitable light sources for the reconditioning discharge device include for example incandescent lamps such as tungsten lamps and halogen lamps, fluorescent lamps, neon lamps, light emitting diodes, and electroluminescent strips. The reconditioning light source may be a broadband light source ranging for example from about 400 to about 900 nanometers, covering the entire spectral sensitivity of the charge generating layer's spectral sensitivity or a narrow-band light source (including a single wavelength light source) ranging for example to any chosen wavelength within the same spectral range (e.g., about 400 to about 900 nanometers) but having a full width at half maximum of say about 50 nanometers and preferably about 10 nanometers. The effectiveness of the wavelength and spectral width in removing the trapped charges in the charge generating layer or at the interface (not its effectiveness in imagewise exposing nor in erasing surface charges) is the main criteria for choosing the spectral content of the reconditioning discharge device.

Where light is used by the reconditioning discharge device, the light exposure provided by the reconditioning discharge device for each image area ranges for example from about 5 to about 50 ergs/cm$^2$, preferably from about 10 to about 30 ergs/cm$^2$.

The present printing machine may use any conventional photoreceptor, including photoreceptors in the configuration of a sheet, a scroll, an endless flexible belt, a web, a cylinder, and the like. In embodiments, the photoreceptor may be sensitive to variations or extremes in temperature in the image area, where the temperature variations result from heating of the image area by charge erase devices combined with variations in airflow in the printing machine cavity causing differential cooling. A photoreceptor having a temperature sensitivity means that the electrical characteristics of the photoreceptor at elevated temperatures will be significantly different than the electrical characteristics at room temperature. Thus, different portions of an image area of a temperature sensitive photoreceptor that are subjected to unequal heating will result in unpredictable print quality.

The present inventors have discovered in certain situations that a tungsten lamp may generate so much heat if employed as a charge erase device in a REaD IOI process that such heat can affect a temperature sensitive photoreceptor. Thus, in embodiments, a charge erase device is other than a tungsten lamp, whereas the reconditioning discharge device can be a tungsten lamp since the reconditioning light source is used only during a non-printing time which would not affect a temperature sensitive photoreceptor.

In a preferred embodiment, the advantage of using one or more charge erase devices with low heat output during printing which may cause residual images combined with using a higher heat reconditioning light source during non-printing times to minimize or eliminate the residual images improves the overall print quality of all images, with none being degraded from temperature sensitivities and none from residual images which are eliminated by the reconditioning discharge device before they become objectionable.

In embodiments, the benefits conferred by the present invention are most evident when the reconditioning discharge device is used only during a non-printing time; if used at other times in conjunction with erase device(s), the reconditioning effect of the light exposure from the reconditioning discharge device on the photoreceptor is decreased.

Figure 8:
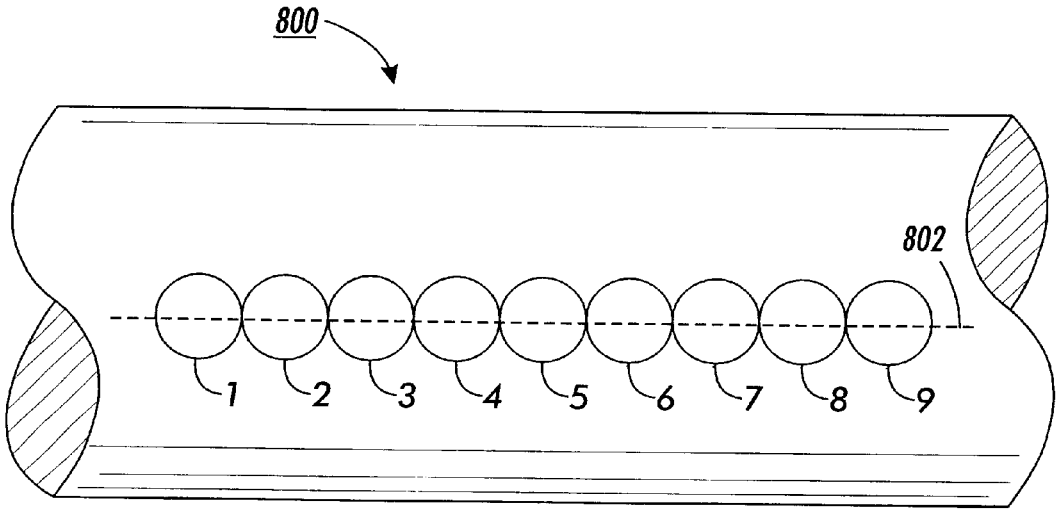
FIG. 8 is a schematic of a discharge device according to other embodiments of the invention.

As mentioned above, embodiments have the emitters arranged along a single axis, as seen, for example, in FIG. 8. The first quantity of emitters can be interspersed with the at least one additional quantity of emitters, as in an alternating relationship. For example, in FIG. 8, emitters 1, 3, 5, 7, and 9 would emit one type of emissions, while emitters 2, 4, 6, and 8 would emit another type of emissions. Thus, the device can be a bar of LEDs arranged so that the first, third, fifth, etc., LEDs belong to the first quantity of emitters and emit a first frequency of light, and the second, fourth, sixth, etc., LEDs belong to a second quantity of emitters emit a second frequency of light. In embodiments employing three emissions, every third emitter can belong to the same group; where four emissions are used, every fourth emitter; where five are used, every fifth emitter; and so forth.

Figure 7:
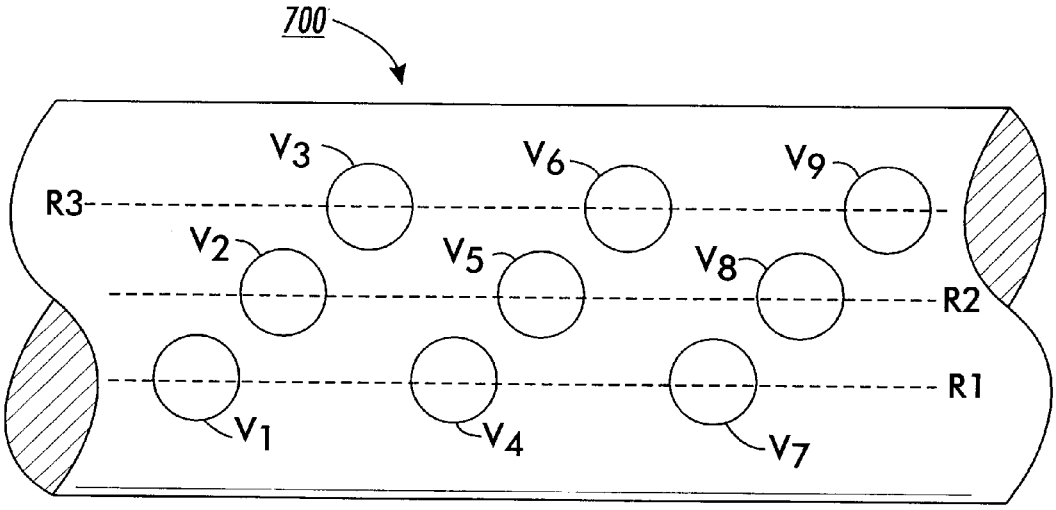
FIG. 7 is a schematic of a discharge device according to embodiments of the invention.

Alternate embodiments have the emitters arranged in rows with each quantity of emitters having its own row or rows. Thus, the device can, for example, take the form of a bar of LEDs arranged in rows along the bar so that the first quantity of emitters is one row of LEDs, a second quantity of emitters is a second row of LEDs, and so forth. Other embodiments could, of course, have the emitters arranged differently, depending on the particular emissions used and the particular environment in which the discharge device is employed. For example, as seen in FIG. 7, the emitters could be arranged in offset rows, with a first row R1 including emitters $V_1$, $V_4$, and $V_7$, a second row R2 including emitters $V_2$, $V_5$, and $V_8$, and a third row R3 including $V_3$, $V_6$, and $V_9$. Each row R1, R2, R3 can comprise a group of emitters that can emit its own respective type of emissions.

As mentioned above, the emitters can be LEDs, and it should be apparent to those of skill in the art that any suitable emitter could be used. Examples of such emitters include, but are not limited to, LEDs, gas discharge lamps, excimer/gas discharge lasers, filament lamps, ion beam generators, and broadband emitters. In embodiments, some or all of the emitters can be tunable so that a single quantity of emitters can emit more than one type of emissions. For example, the device could include a bar of tunable LEDs that can selectively emit different wavelengths of light as conditions warrant.

Again, embodiments of the device can be used to discharge image receivers in various ways. For example, embodiments can be used to image, erase, and/or recondition photoreceptor belts and other image receivers, especially in electrostatographic printing devices, like laser printers and digital photocopiers. In particular, embodiments can be employed to discharge photoreceptors with a single layer responsive to the emissions, whereas prior art multiple wavelength devices encompasses only multiple layer photoreceptors. In such embodiments, the discharge device can be used by providing the device in an electrostatographic printing machine including a photoreceptor, selectively directing emissions from the first quantity of the plurality of emitters at the photoreceptor to induce a first level of discharge of the photoreceptor, and selectively directing emissions from the at least one more quantity of the plurality of emitters at the photoreceptor to induce at least one additional level of discharge of the photoreceptor.

Other modifications of the present invention may occur to those skilled in the art based upon a reading of the present disclosure and these modifications are intended to be included within the scope of the subject invention.

We claim:

1. An image receiver discharge device comprising:

a plurality of emitters distributed along the discharge device to selectively image an image receiver of an electrostatographic printing machine;

a first quantity of the plurality of emitters emitting first emissions selectively emitted at the image receiver that can selectively change the charge state of the image receiver;

at least one more quantity of the plurality of emitters emitting at least one respective additional emission selectively emitted at the image receiver that can selectively change the charge state of the image receiver wherein the emissions are ions.

2. An image receiver discharge device comprising:

a plurality of emitters distributed along the discharge device to selectively image an image receiver of an electrostatographic printing machine;

a first quantity of the plurality of emitters emitting first emissions selectively emitted at the image receiver that can selectively change the charge state of the image receiver;

at least one more quantity of the plurality of emitters emitting at least one respective additional emission selectively emitted at the image receiver that can selectively change the charge state of the image receiver configured in an electrostatographic printing machine to discharge an image receiver wherein the image receiver comprises a photoreceptor with a single layer responsive to the first and at least one respective additional emission.

3. An image receiver discharge device comprising:

a plurality of emitters distributed along the discharge device to selectively image an image receiver of an electrostatographic printing machine;

a first quantity of the plurality of emitters emitting first emissions selectively emitted at the image receiver that can selectively change the charge state of the image receiver;

at least one more quantity of the plurality of emitters emitting at least one respective additional emission selectively emitted at the image receiver that can selectively change the charge state of the image receiver;

providing the device in an electrostatographic printing machine including a photoreceptor the image receiver comprising the photoreceptor;

selectively directing emissions from the first quantity of the plurality of emitters at the photoreceptor to induce a first level of discharge of the photoreceptor;

selectively directing emissions from the at least one more quantity of the plurality of emitters at the photoreceptor to induce at least one additional level of discharge of the photoreceptor;

arranging the device as part of a reconditioning station;

selectively inducing the first level of discharge to selectively achieve a first degree of photoreceptor reconditioning;

selectively inducing the at least one additional level of discharge to selectively achieve at least one additional degree of photoreceptor reconditioning.

4. An image receiver discharge device comprising:

a plurality of emitters distributed along the discharge device to selectively image an image receiver of an electrostatographic printing machine;

a first quantity of the plurality of emitters emitting first emissions selectively emitted at the image receiver that can selectively change the charge state of the image receiver;

at least one more quantity of the plurality of emitters emitting at least one respective additional emission selectively emitted at the image receiver that can selectively change the charge state of the image receiver;

providing the device in an electrostatographic printing machine including a photoreceptor, the image receiver comprising the photoreceptor;

selectively directing emissions from the first quantity of the plurality of emitters at the photoreceptor to induce a first level of discharge of the photoreceptor;

selectively directing emissions from the at least one more quantity of the plurality of emitters at the photoreceptor to induce at least one additional level of discharge of the photoreceptor;

arranging the device as part of an erase station;

selectively inducing the first level of discharge to selectively achieve a first degree of photoreceptor erasure;

selectively inducing the at least one additional level of discharge to selectively achieve at least one additional degree of photoreceptor erasure.

5. An image receiver discharge device comprising:

a plurality of emitters distributed along the discharge device to selectively image an image receiver of an electrostatographic printing machine;

a first quantity of the plurality of emitters emitting first emissions selectively emitted at the image receiver that can selectively change the charge state of the image receiver;

at least one more quantity of the plurality of emitters emitting at least one respective additional emission selectively emitted at the image receiver that can selectively change the charge state of the image receiver;

providing the device in an electrostatographic printing machine including a photoreceptor, the image receiver comprising the photoreceptor;

selectively directing emissions from the first quantity of the plurality of emitters at the photoreceptor to induce a first level of discharge of the photoreceptor;

selectively directing emissions from the at least one more quantity of the plurality of emitters at the photoreceptor to induce at least one additional level of discharge of the photoreceptor;

arranging the device as part of an erase station;

selectively inducing the first level of discharge to selectively achieve a first degree of photoreceptor erasure;

selectively inducing the at least one additional level of discharge to selectively achieve at least a first degree of photoreceptor reconditioning.

6. An electrostatographic discharge device including a plurality of light emitters distributed on the discharge device, the plurality of light emitters emitting a plurality of wavelengths of light that can discharge and image a photoreceptor, each of at least a portion of the plurality of light emitters can each selectively emit at least two of the plurality of wavelengths of light.

7. The discharge device of claim 6 wherein the emitters in the at least a portion of the plurality of light emitters are tunable diodes.

8. The discharge device of claim 6 wherein the emitters in the at least a portion of the plurality of light emitters are tunable gas discharge devices.

9. The discharge device of claim 6 wherein portions of the plurality of light emitters emit respective wavelengths of the plurality of wavelengths of light.

10. The discharge device of claim 9 wherein the portions of plurality of light emitters are interspersed with each other along the discharge device.

11. An electrostatographic printing machine comprising:

a photoreceptor having an image area;

at least one charging apparatus and at least one imaging apparatus that create a plurality of complementary electrostatic latent images on the image area to correspond to an image wherein the creation of the plurality of the complementary electrostatic latent images involves a substantially uniform charging and an imagewise discharge of the image area for each of the complementary electrostatic latent images and results in a variation in the quantity of trapped charges among different portions of the image area, thereby leading to differential residual voltage among the different portions of the image area;

a plurality of complementary electrostatic latent image developing apparatus;

a charge erase device that directs charge dissipation emissions at the photoreceptor to reduce the quantity of the surface charges; and a reconditioning emission source that directs reconditioning emissions at the photoreceptor to reduce the variation in the quantity of the trapped charges among the different portions of the image area, thereby creating a more uniform residual voltage among the different portions of the image area;

at least one of the imaging apparatus, the charge erase device, and the reconditioning emission source being configured to emit emissions of at least two characters.

12. The printing machine of claim 11 wherein the character of one of the emissions includes ionic emission.

13. The printing machine of claim 11 wherein the character of one of the emissions includes a first frequency of light.

14. The printing machine of claim 11 wherein the plurality of light emitters include light emitters that emit a respective one of the at least two frequencies of light.

15. The printing machine of claim 11 wherein at least some of the light emitters can selectively emit all of the at least two frequencies of light.

16. The printing machine of claim 11, wherein the reconditioning light source is a tungsten lamp.

17. The printing machine of claim 11, wherein the reconditioning light source is a broadband light source.

18. The printing machine of claim 11, wherein the reconditioning light source directs light at the photoreceptor only during a non-printing time.

19. The printing machine of claim 11, further comprising another charge erase device that directs charge dissipation emissions at the photoreceptor to reduce the quantity of the surface charges.

20. The printing machine of claim 11, wherein the charge erase device is a light source.

21. The printing machine of claim 11, wherein the photoreceptor has a front surface and a rear surface and the reconditioning light source is positioned facing the front surface of the photoreceptor.

22. The printing machine of claim 11, wherein the electrical characteristics of the photoreceptor are sensitive to variations in temperature in the image area.

* * * * *